US007104528B2

(12) United States Patent
Rock

(10) Patent No.: US 7,104,528 B2
(45) Date of Patent: Sep. 12, 2006

(54) FUEL PROCESSOR APPARATUS AND METHOD

(75) Inventor: Kelly P. Rock, San Clemente, CA (US)

(73) Assignee: LyteSyde, LLC, Henderson, NV (US)

( * ) Notice: Subject to any disclaimer, the term of this patent is extended or adjusted under 35 U.S.C. 154(b) by 407 days.

(21) Appl. No.: 10/641,419

(22) Filed: Aug. 15, 2003

(65) Prior Publication Data

US 2005/0035219 A1 Feb. 17, 2005

(51) Int. Cl.
*F02M 19/03* (2006.01)

(52) U.S. Cl. ..... 261/78.1; 261/78.2; 261/79.1; 261/79.2; 261/DIG. 55

(58) Field of Classification Search ..... 261/79.1, 261/79.2, DIG. 55, 78.1, 78.2; 239/403, 239/406; 60/737
See application file for complete search history.

(56) References Cited

U.S. PATENT DOCUMENTS

| | | | | | |
|---|---|---|---|---|---|
| 634,242 | A | | 10/1899 | Lambert | 261/79.1 X |
| 751,292 | A | | 2/1904 | Johanson | 261/79.1 X |
| 860,259 | A | | 7/1907 | Smith | 261/79.1 X |
| 1,163,437 | A | | 12/1915 | Morison | 261/8 |
| 1,233,557 | A | | 7/1917 | Curtis | 261/79.1 X |
| 1,313,521 | A | | 8/1919 | Connor et al. | 261/79.1 X |
| 1,309,719 | A | | 9/1919 | Curtis | 261/79.1 X |
| 1,451,063 | A | | 4/1923 | Anthony | 239/406 |
| 1,471,220 | A | | 10/1923 | Tangye | 261/79.1 |
| 1,626,085 | A | | 4/1927 | Henriot | 261/79.1 X |
| 2,071,717 | A | | 2/1937 | Winkle | 261/79.1 X |
| 2,413,420 | A | * | 12/1946 | Stephanoff | 34/364 |
| 2,599,422 | A | | 6/1952 | Yettaw | 299/140 |
| 3,286,997 | A | | 11/1966 | Ledbetter | 261/79.1 X |
| 3,336,017 | A | | 8/1967 | Kopa | 261/79.1 X |
| 3,395,899 | A | | 8/1968 | Kopa | 261/22 |
| 3,414,242 | A | | 12/1968 | Bouteleux | 261/79.1 X |
| 3,512,359 | A | * | 5/1970 | Pierce | 60/748 |
| 3,651,619 | A | | 3/1972 | Miura | 261/79.2 X |
| 3,667,221 | A | | 6/1972 | Taylor | 261/79.1 X |
| 3,778,038 | A | | 12/1973 | Eversole et al. | 261/79.1 X |
| 3,866,585 | A | | 2/1975 | Kopa | 123/127 |
| 3,944,634 | A | | 3/1976 | Gerlach | 261/79.1 X |
| 4,062,663 | A | * | 12/1977 | Spevack | 96/311 |
| 4,087,862 | A | | 5/1978 | Tsien | 366/184 |
| 4,159,881 | A | | 7/1979 | Gogneau | 366/337 |
| 4,215,535 | A | | 8/1980 | Lewis | 261/79.1 X |
| 4,217,313 | A | | 8/1980 | Dmitrievsky et al. | 261/79.1 X |
| 4,320,092 | A | * | 3/1982 | Kondo et al. | 422/224 |
| 4,464,314 | A | | 8/1984 | Surovikin et al. | 261/79.2 |
| 4,515,734 | A | | 5/1985 | Rock et al. | 261/DIG. 21 |
| 4,568,500 | A | | 2/1986 | Rock et al. | 261/DIG. 19 |
| 4,726,686 | A | | 2/1988 | Wolf et al. | 210/512.1 X |

(Continued)

FOREIGN PATENT DOCUMENTS

| | | | |
|---|---|---|---|
| DE | 1108666 | 6/1961 | 261/79.2 |

(Continued)

*Primary Examiner*—Richard L. Chiesa
(74) *Attorney, Agent, or Firm*—Holland & Hart

(57) ABSTRACT

The present invention relates to an improved fuel processor for preparing fuel prior to introducing the fuel into a combustor utilized in connection with a gas internal combustion engine. The fuel processor of the present invention efficiently maintains an internal vacuum by balancing the surface area of the air intake with the atomized air/fuel combination output. In addition, the fuel processor eliminates the helical effects on the ejected air/fuel combination but maintains the atomized chemical state. The fuel processor conforms to industry standards and could therefore easily be incorporated with existing technology.

14 Claims, 6 Drawing Sheets

U.S. PATENT DOCUMENTS

| | | | | |
|---|---|---|---|---|
| 4,943,704 | A | 7/1990 | Rabenau et al. | 261/79.2 X |
| 5,071,068 | A | 12/1991 | Suniewski | 239/8 |
| 5,169,302 | A | 12/1992 | Keller | 431/350 |
| 5,340,306 | A | 8/1994 | Keller et al. | 431/354 |
| 5,472,645 | A | 12/1995 | Rock et al. | 261/79.1 |
| 5,512,216 | A | 4/1996 | Rock et al. | 261/79.1 |
| 5,672,187 | A | 9/1997 | Rock et al. | 261/79.1 X |
| 6,113,078 | A | 9/2000 | Rock | 261/79.1 X |
| 6,151,899 | A * | 11/2000 | Park | 60/748 |
| 6,244,573 | B1 | 6/2001 | Rock | 261/79.1 X |
| 6,347,789 | B1 | 2/2002 | Rock | 261/79.1 |
| 6,536,748 | B1 * | 3/2003 | Tachihara et al. | 261/79.2 |
| 2003/0155666 | A1 * | 8/2003 | Amou et al. | 261/79.1 |
| 2004/0021235 | A1 * | 2/2004 | Corr et al. | 261/79.1 |
| 2004/0061001 | A1 * | 4/2004 | Mao et al. | 239/398 |

FOREIGN PATENT DOCUMENTS

| | | | | |
|---|---|---|---|---|
| DE | 35 11 094 | A1 | 10/1986 | |
| DE | G94 02 811.7 | | 7/1994 | |
| DE | 44 27 466 | A1 | 2/1996 | |
| FR | 746984 | | 6/1933 | 261/79.1 |
| FR | 1156341 | | 5/1958 | 261/79.2 |
| GB | 2 296 037 | A | 6/1996 | |
| JP | 57-92622 | * | 6/1982 | 60/737 |
| SU | 1357032 | | 12/1987 | 261/79.2 |
| WO | WO 85/03741 | | 8/1985 | |

* cited by examiner

FUEL PROCESSOR APPARATUS AND METHOD

FIELD OF THE INVENTION

This invention relates to fuel processors, and more particularly to fuel processors for use in connection with internal combustion engines.

BACKGROUND OF THE INVENTION

For years there have been efforts to improve the efficiency of fuel combustion for internal combustion engines. While fuel processors for internal combustion engines are a primary interest for design improvement efforts, fuel processors used in a number of other applications are also in need of improvement. Any fuel consumption device may benefit from an improved processor device or processing method prior to the fuel being consumed or combusted.

One of the key aspects to any internal combustion engine relates to the proper and efficient burning of fuel within the fuel combustion chamber. As those skilled in the art understand, the more finely and homogenously processed the fuel, the more efficient and effective it will burn. Increased fuel efficiency is always desirable in turbine engines.

Accordingly, there has been and continues to be a need to develop a more efficient way to process and burn fuel within a fuel combustion chamber of an internal combustion engine. The present invention solves the longstanding problems associated with improper or incomplete fuel processing prior to combustion within a combustion chamber of an internal combustion engine.

SUMMARY OF THE INVENTION

The present invention relates to an improved fuel processor for preparing fuel prior to introducing the fuel into a combustor utilized in connection with a gas internal combustion engine. The fuel processor of the present invention efficiently maintains an internal vacuum by balancing the surface area of the air intake with the atomized air/fuel combination output. In addition, the fuel processor eliminates the helical effects on the ejected air/fuel combination but maintains the atomized chemical state. The fuel processor conforms to industry standards and could therefore easily be incorporated with existing technology.

In one embodiment, a fuel processor includes a novel exit nozzle that eliminates helical properties of an ejected atomized air/fuel combination. The exit nozzle includes an outwardly tapering conical center hole and a plurality of outwardly tapering cylindrical holes. The angle at which the conical center hole tapers is greater than the angle at which the plurality of cylindrical holes taper. Therefore, the conical center hole bisects the cylindrical holes causing bullet like channels to be formed in the cavity of the conical center hole. As the atomized air/fuel combination travels through the conical center hole and cylindrical holes, the helical properties are eliminated without affecting the atomized state.

In a second embodiment, a fuel processor includes a novel air intake that injects ambient air into the processor while maintaining the necessary pressure differential with the exit nozzle so as to maintain an internal vacuum. The spiral holes on the air intake are configured such that the total surface area of the spiral holes equal the total surface area of the holes on the exit nozzle. By matching these areas, the internal vacuum is maintained.

The foregoing and other features, utilities, and advantages of the invention will become apparent from the following more detailed description of the invention with reference to the accompanying drawings.

DETAILED DESCRIPTION OF THE INVENTION

Presently preferred embodiments of the invention are described below with reference to the accompanying drawings. Those skilled in the art will understand that the drawings are diagrammatic and schematic representations of presently preferred embodiments, and should not limit the scope of the claimed invention.

The present invention relates to an improved fuel processor for preparing fuel prior to introducing the fuel into a combustor utilized in connection with a gas internal combustion engine. The fuel processor of the present invention efficiently maintains an internal vacuum by balancing the surface area of the air intake with the atomized air/fuel combination output. In addition, the fuel processor eliminates the helical effects on the ejected air/fuel combination but maintains the atomized chemical state. The fuel processor conforms to industry standards and could therefore easily be incorporated with existing technology. While embodiments of the present invention are described in the context of components to be included in a fuel processor, those skilled in the art will appreciate that the teachings of the present invention could be applied to other applications as well. For example, the present invention could be applied to a processor configured to process other types of liquid including but not limited to water, alcohol, oil, etc.

Figure 1:
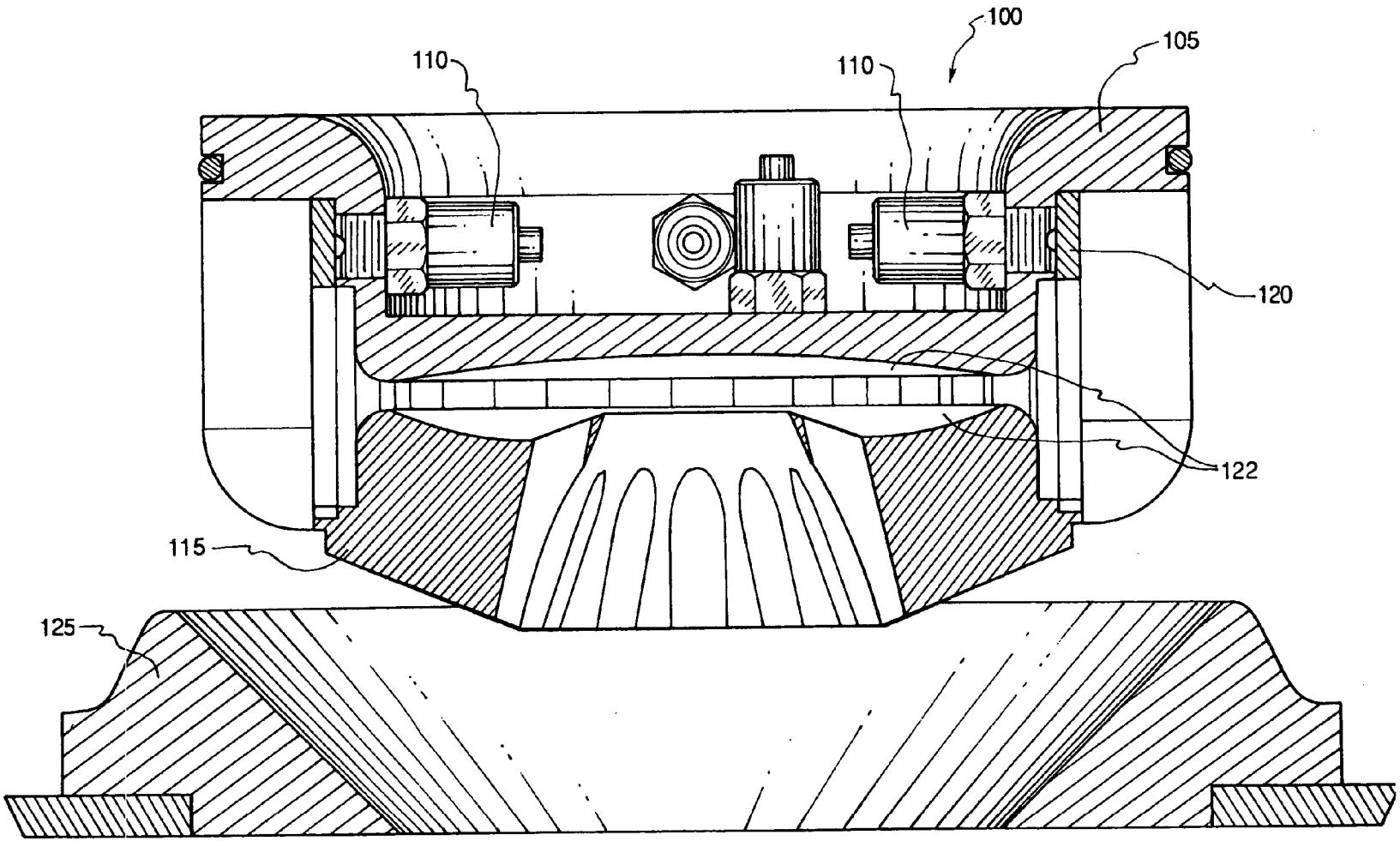
FIG. 1 is a diagrammatic view of a fuel atomizing processor incorporating improvements from the present invention.

FIG. 1 illustrates a fuel atomizing processor 100 incorporating improvements from the present invention. It is well understood by those skilled in the art as to the basic operation of such a fuel processor. As shown, air enters into the processor wherein the pressure of the air is increased. Fuel is injected into the processor via a plurality of fuel injectors. The air and fuel are atomized in a vortical manner into an atomized air fluid combination. The atomized air fluid combination is ejected out an exit nozzle that negates all helical properties but maintains the atomized state.

The fuel atomizing processor 100 further includes a plurality of fuel injectors 110, a processor anvil 105, an air intake 120, an exit nozzle 115, and a restrictor plate 125. The fuel injectors 110 inject fuel into the fuel atomizing processor 100 in a liquid state. The fuel injectors 110 are generally coupled to a fuel supply line (not shown). The liquid fuel is transferred in a circular manner from the outer edge of the fuel atomizing processor 100 towards the center of the vortex chamber 122. The vortex chamber 122 is formed between the processor anvil 105 and the exit nozzle 115. The processor anvil 105 and the exit nozzle 115 are shaped to maintain a consistent circular area in the vortex chamber 122 as the fuel transfers in a circular manner towards the center of the vortex chamber 122. The circular area is the circumference of the fuels location multiplied by the height of the vortex chamber 122 at that particular location. Therefore, in order to maintain a constant circular area within the vortex chamber 122, the processor anvil 105 and the exit nozzle 115 must widen towards the center of the vortex chamber 122.

The air intake 120 injects ambient air into the fuel atomizing processor 100 to assist in atomizing the fuel. The injected air is automatically pressurized once it enters the fuel atomizing processor 100 due to an internal vacuum within the fuel atomizing processor 100. The internal vacuum is maintained by properly calibrating the area of the air intake to equal the air output. Air is also injected into the fuel atomizing processor 100 at the sides of the vortex chamber 122. The air intake 120 is designed to inject air into the fuel atomizing processor 100 at an angle so as to facilitate the creation of a tornado or vortex affect when combined with the internal vacuum.

The exit nozzle 115 is configured to eject an atomized air/fuel combination created within the vortex chamber 122 of the fuel atomizing processor 100. The ejected atomized air/fuel combination is then transferred through a restrictor plate 125 that is configured to maintain the atomized state of the atomized air/fuel combination. The restrictor plate 125 is commonly used to transfer the atomized air/fuel combination to a second processor (as discussed in more detail with reference to FIG. 8).

Figure 2:
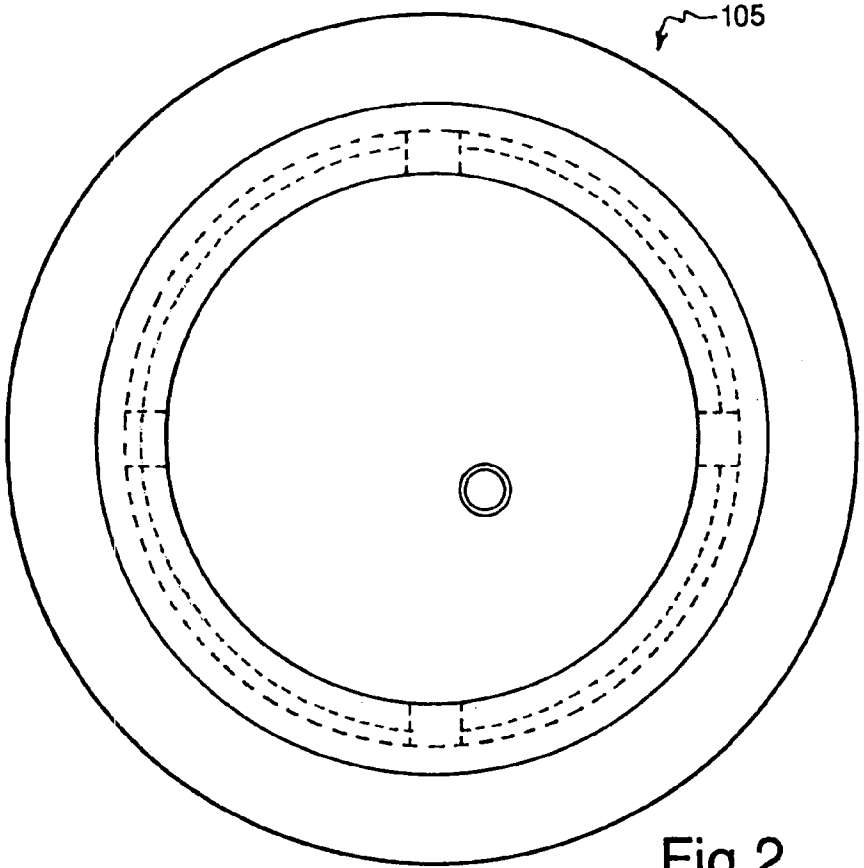
FIG. 2 is an elevation view of the top of the processor anvil from FIG. 1 according to one embodiment of the present invention.

Reference is next made to FIG. 2, which illustrates a top view of the processor anvil from FIG. 1 according to one embodiment of the present invention. As discussed above, the processor anvil 105 is shaped to maintain a constant circular area as the injected liquid fuel is transferred to the center of the vortex chamber 122. In addition, the processor anvil 105 includes receptacles through which the fuel injectors 110 inject liquid fuel into the fuel atomizing processor 100.

Figure 3:
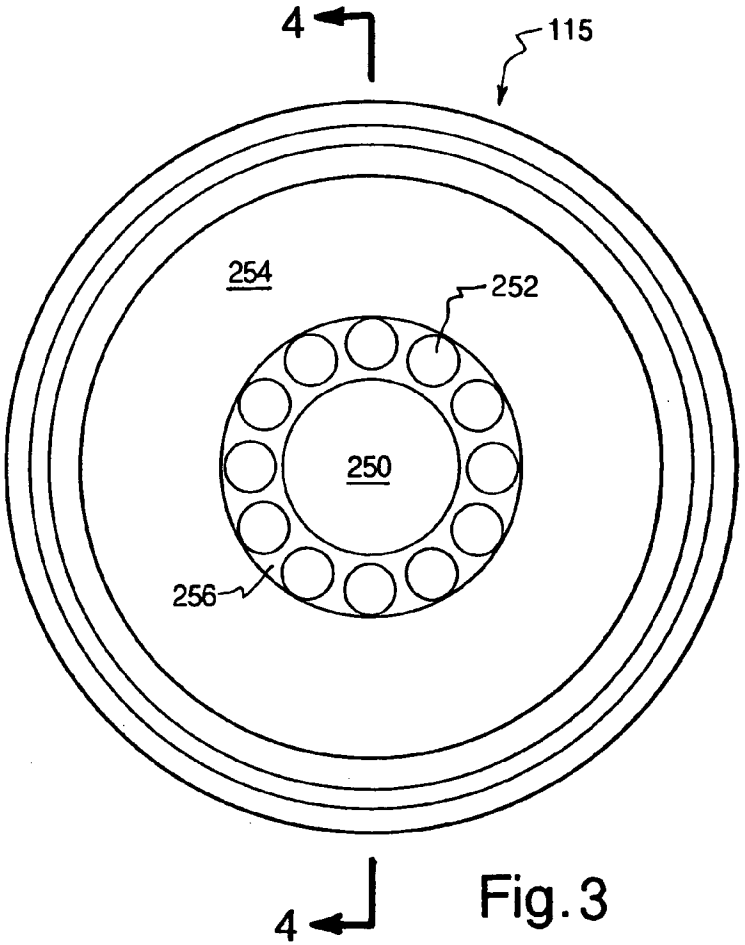
FIG. 3 is an elevation view of the top of the exit nozzle from FIG. 1 according to one embodiment of the present invention.
Figure 5:
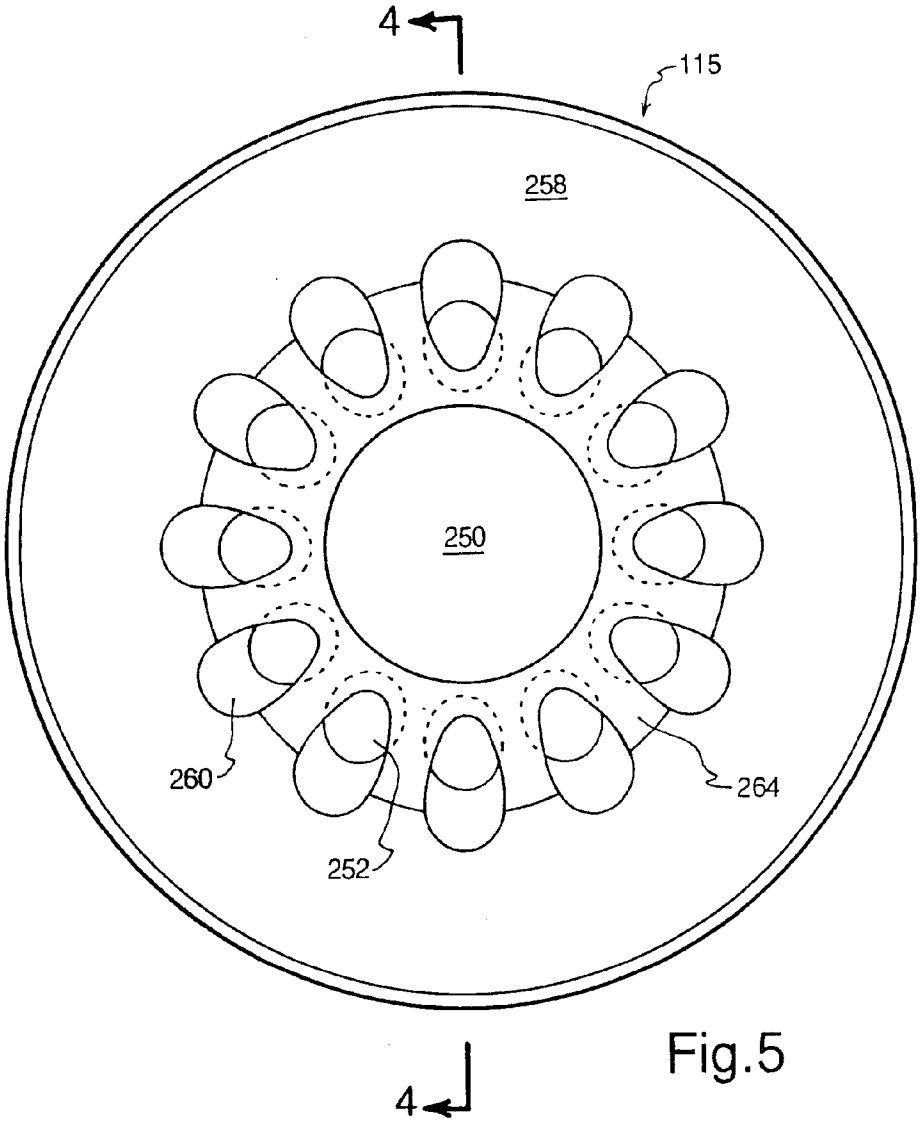
FIG. 5 is an elevation view of the bottom of the exit nozzle from FIG. 1 according to one embodiment of the present invention.
Figure 4:
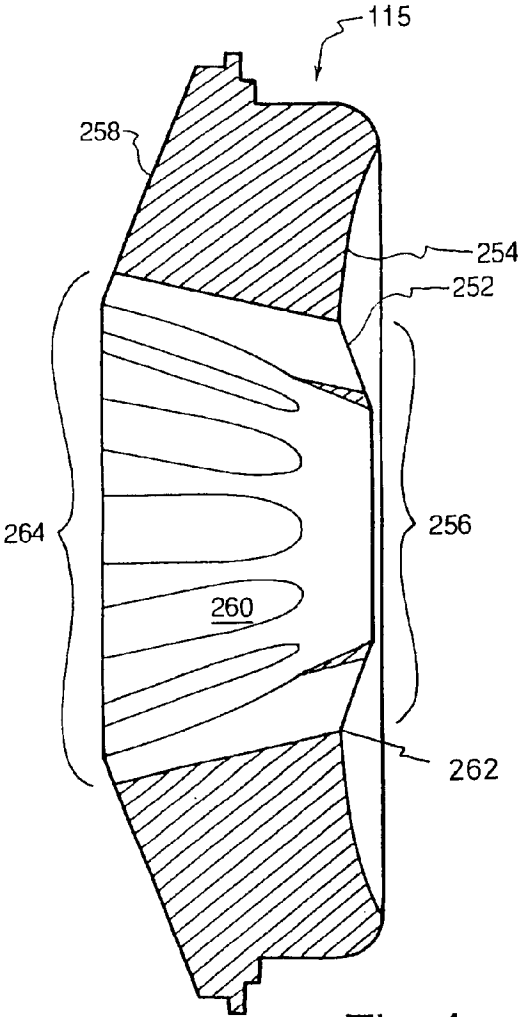
FIG. 4 is a sectional elevation view of the exit nozzle from FIG. 1 according to one embodiment of the present invention, wherein the top of the exit nozzle is shown on the right.

Reference is next made to FIGS. 3–5, which illustrate the exit nozzle from FIG. 1 according to one embodiment of the present invention. As described above, the exit nozzle 115 removes any helical properties from the atomized air/fuel combination and maintains the atomized state. FIG. 3 and 5 illustrate a top and bottom view of the exit nozzle respectively, and FIG. 4 illustrates a cross sectional view along the lines 4—4 shown in FIGS. 3 and 5. The exit nozzle 115 further includes an outward tapering conical center hole 250 and a plurality of outward tapering cylindrical holes 252. The surface area of the outward tapering conical center hole 250 is equal to the combined surface area of all of the outward tapering cylindrical holes 252. The outward tapering conical center hole 250 tapers at an angle greater than the outward tapering cylindrical holes 252. Therefore, the outward tapering cylindrical holes 252 are bisected or chopped by the outward tapering conical center hole 250.

The top of the exit nozzle 115 shown in FIG. 3 illustrates the preliminary separation between the outward tapering conical center hole 250 and the outward tapering cylindrical holes 252. The holes 250, 252 are positioned in the center of the exit nozzle 115 in a raised portion 256 as shown in FIG. 4. The cylindrical holes 252 are disposed on the outer sloping edges of the raised portion 256 and the conical hole 250 is disposed in the level middle of the raised portion 256. The surrounding surface of the exit nozzle 115 is referred to as the upper plate 254. FIG. 4 illustrates how the upper plate 254 slopes between the raised portion 256 and the outer edge of the exit nozzle 115.

The outward tapering cylindrical holes 252 are bisected by the outward tapering conical center hole 250 in a manner to create bullet like channels 260 in the cavity 264 of the conical center hole 250. The cavity 264 of the conical center hole 250 is the expanded region within the conical center hole as it tapers outwardly towards the bottom of the exit nozzle 115. The bullet like channels 260 are the regions of the cylindrical holes 252 that intersect the cavity 264 of the conical center hole 250 and are illustrated in FIGS. 4 and 5. FIG. 5 shows in partial phantom where the cylindrical holes 252 begin at the top of the exit nozzle 115. As the cylindrical holes 252 extend down towards the bottom of the exit nozzle 115, they are bisected by the conical center hole 250 and form the bullet like channels 260 in the cavity 264 of the conical center hole 250 rather than a complete cylindrical hole. The cavity 264 of the conical center hole 250 and the bullet like channels 260 of the cylindrical holes 252 terminate on the bottom side of the exit nozzle 115 on a bottom raised portion 262 as shown in FIG. 4. The bottom raised portion 262 is surrounded by a bottom plate 258 that extends between the bottom raised portion 262 and the outer edge of the exit nozzle 115. The bottom plate 258 slopes down from the bottom raised portion 262 to the outer edge of the exit nozzle 115 as shown in FIG. 4.

In practice, by forcing the atomized air/fuel combination through both the outward tapering conical center hole 250 and the outward tapering cylindrical holes 252 in the manner shown, the helical properties will be removed from the atomized air/fuel combination. The tapering angles and the bisection between the conical center hole and the cylindrical holes utilizes a novel technique in removing the helical properties from the atomized air/fuel combination.

Figure 7:
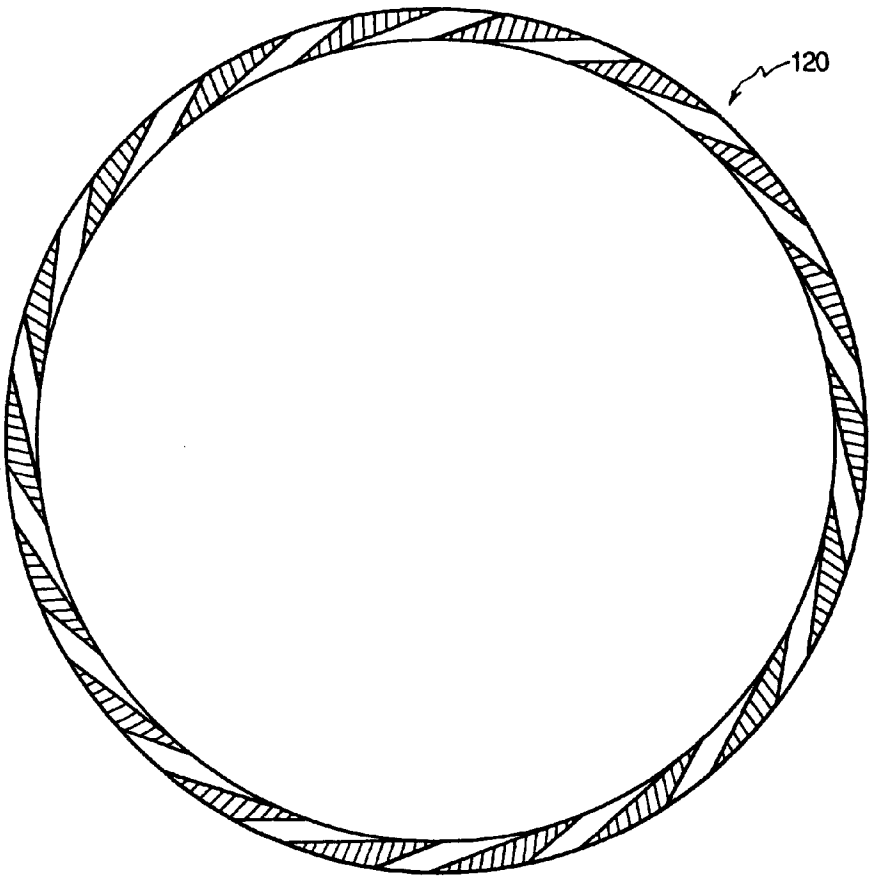
FIG. 7 is an elevation view of the air intake from FIG. 1 according to one embodiment of the present invention.
Figure 6:
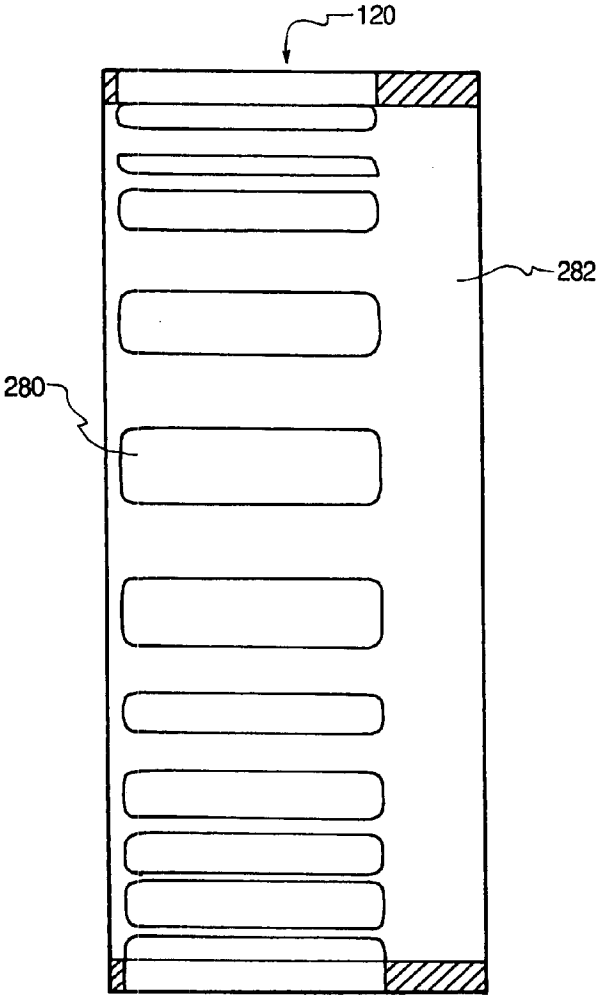
FIG. 6 is an elevation profile view of the air intake from FIG. 1 according to one embodiment of the present invention.

Reference is next made to FIGS. 6 and 7, which illustrate an air intake 120 from FIG. 1 in accordance with one embodiment of the present invention. FIG. 6 illustrates a profile view of the air intake 120 and FIG. 7 illustrates a top view. The fuel atomizing processor 100 utilizes the air intake to inject ambient air into the processor in a manner to create a vortex. The vortex is utilized in combining the air and fuel into the atomized air/fuel combination. The air intake 120 further includes a body 282 and a plurality of spiral holes 280. The spiral holes 280 are spiraled to swirl the incoming ambient air as shown in FIG. 7. The air intake 120 of the illustrated embodiment includes 18 spiral holes 280 on the air intake. The total surface area of all of the spiral holes 280 is equal to the total surface area of the conical center hole and cylindrical holes 250, 252 on the exit nozzle 115 so as to maintain a vacuum within the fuel atomizing processor 100.

Figure 8:
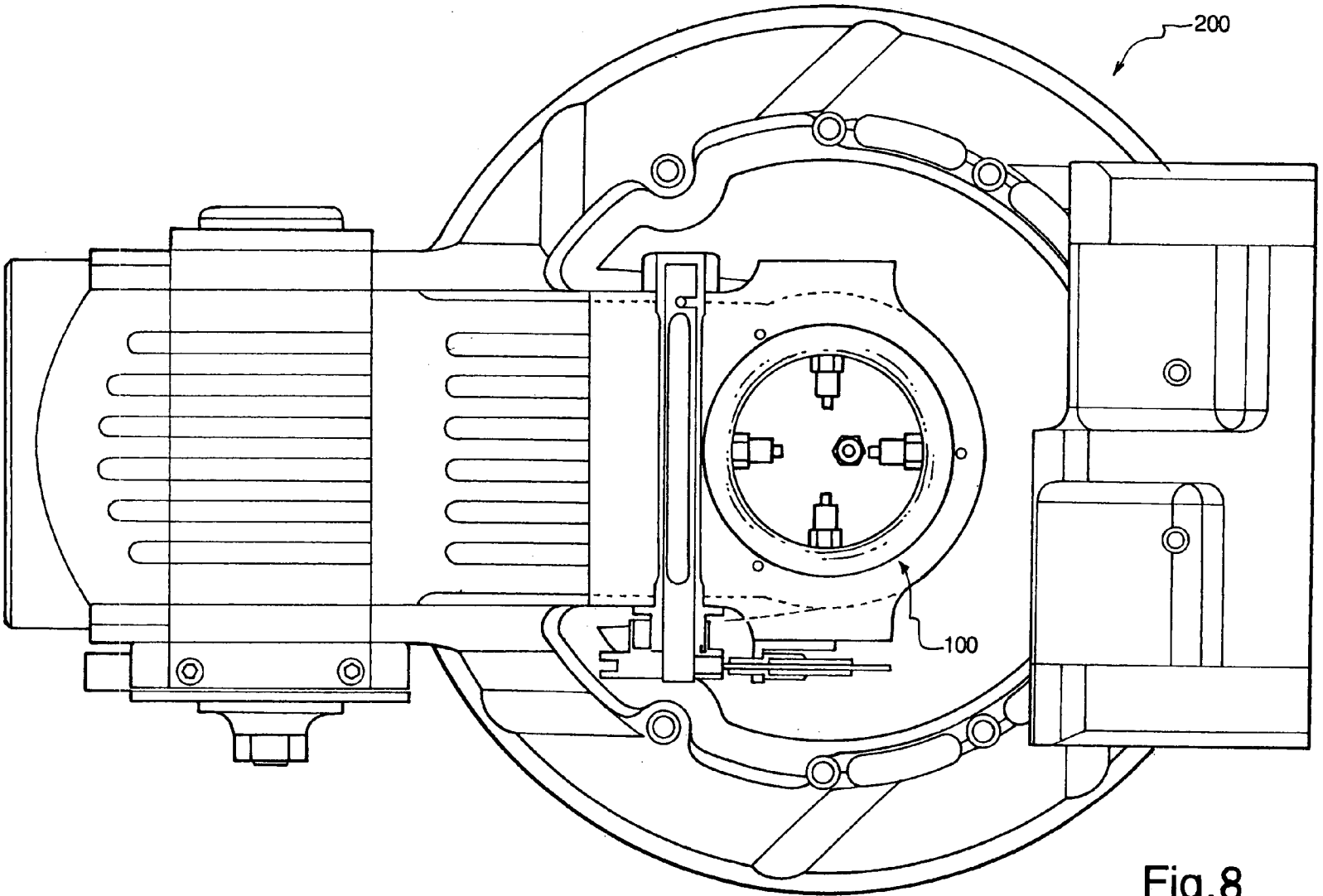
FIG. 8 is a diagrammatic top view of a fuel atomizing dual processor incorporating improvements from the present invention.
Figure 9:
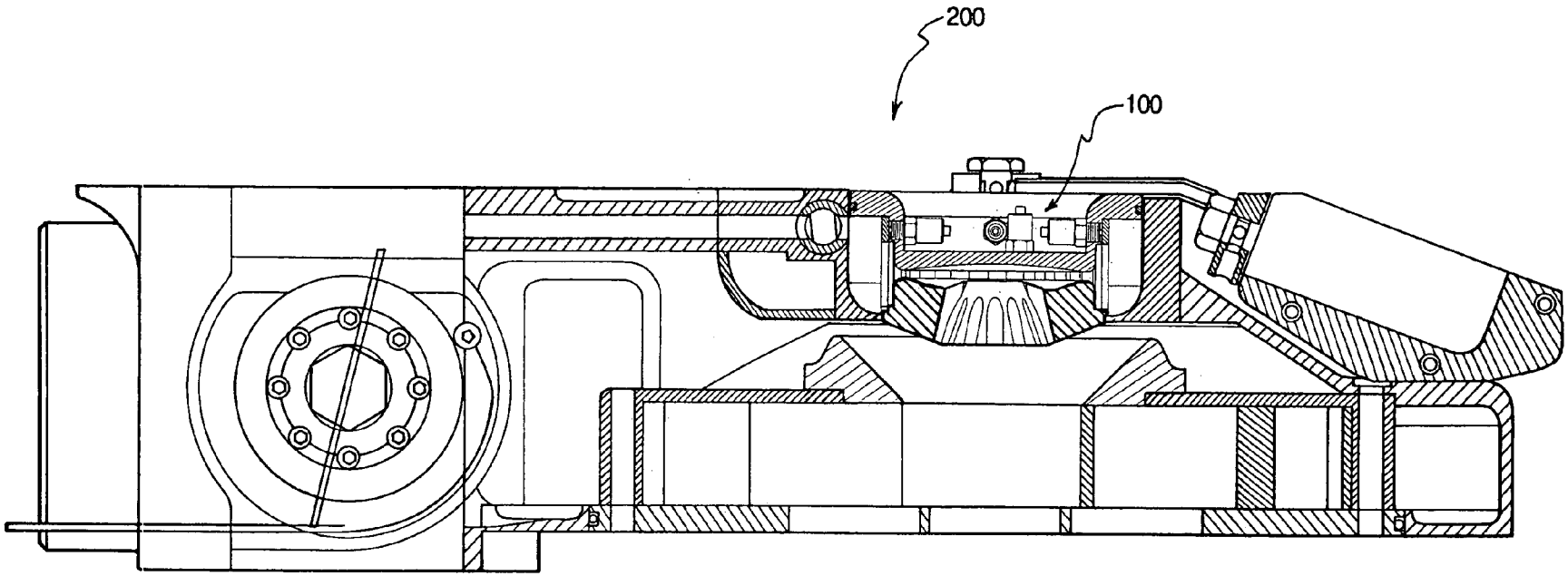
FIG. 9 is a diagrammatic profile view of a fuel atomizing dual processor incorporating improvements from the present invention.

Reference is next made to FIGS. 8 and 9, which illustrate a fuel atomizing dual processor incorporating improvements from the present invention. FIG. 8 illustrates a top view of the dual processor 200 and FIG. 9 illustrates a profile view of the dual processor 200. The fuel atomizing processor 100 described with reference to FIGS. 1–7, incorporating embodiments of the present invention, can be incorporated into a dual processor as shown.

While this invention has been described with reference to certain specific embodiments and examples, it will be recognized by those skilled in the art that many variations are possible without departing from the scope and spirit of this invention. The invention, as described by the claims, is intended to cover all changes and modifications of the invention which do not depart from the spirit of the invention. The words "including" and "having," as used in the specification, including the claims, shall have the same meaning as the word "comprising."

The invention claimed is:

1. A device for atomizing fluid particles comprising:

a fluid injection system to inject fluid into a processor;

an air intake to inject air into the device;

a vortex chamber that atomizes fluid from the fluid injection system with air from the air intake to create an atomized air fluid combination; and an exit nozzle that ejects the atomized air fluid combination, wherein the exit nozzle includes an outward tapering conical center hole and a plurality of outward tapering cylindrical holes, and wherein the outward tapering cylindrical holes intersect the conical center hole in a manner to negate all helixing in the atomized air fluid combination.

2. The processor of claim 1 wherein the outward tapering cylindrical holes have a total internal surface area equal to a total internal surface area of the conical center hole.

3. The processor of claim 1 wherein the fluid injection system includes at least one fuel injector.

4. The processor of claim 1 wherein the air intake includes a plurality of holes having a total surface area equal to the total internal surface area of the conical center hole and plurality of outward tapering cylindrical holes.

5. The processor of claim 1 wherein the outward tapering cylindrical holes taper at an angle less than the outward taper of the conical center hole.

6. The processor of claim 1 wherein the vortex chamber utilizes a tornado affect to atomize the liquid and air.

7. The processor of claim 1 wherein the air intake injects ambient air into the processor.

8. A processor for atomizing fluid particles comprising:

a fluid injection system for injecting fluid into the processor;

an air intake for injecting air into the processor and wherein the air intake includes an input surface area;

a vortex chamber that atomizes fluid from the fluid injection system with air from the air intake to create an atomized air fluid combination; and an exit nozzle that ejects the atomized air fluid combination, wherein the exit nozzle includes an output surface area, and wherein the output surface area is calibrated to be substantially equal to the input surface area so as to maintain a pressure differential to generate and maintain an internal vacuum.

9. The processor of claim 8 wherein the fluid injection system includes at least one fuel injector.

10. The processor of claim 8 wherein the exit nozzle includes an outward tapering conical center hole and a plurality of outward tapering cylindrical holes; and wherein the air intake includes a plurality of holes having a total surface area equal to the total internal surface area of the conical center hole and plurality of outward tapering cylindrical holes.

11. The processor of claim 8 wherein the vortex chamber utilizes a tornado affect to atomize the liquid and air.

12. The processor of claim 8 wherein the air intake injects ambient air into the processor.

13. A processor for atomizing fluid particles comprising:

a fluid injection system for injecting fluid into the processor;

an air intake for injecting air into the processor and wherein the air intake includes an input surface area;

a vortex chamber that atomizes fluid from the fluid injection system with air from the air intake to create an atomized air fluid combination; and an exit nozzle that ejects the atomized air fluid combination, wherein the exit nozzle includes an output surface area, and wherein the output surface area is substantially equal to the input surface area so as to maintain a pressure differential to generate and maintain an internal vacuum;

wherein the wherein the exit nozzle includes an outward tapering conical center hole and a plurality of outward tapering cylindrical holes, and wherein the outward tapering cylindrical holes intersect the conical center hole in a manner to negate all helixing in the atomized air fluid combination.

14. A processor for atomizing fluid particles comprising:

a fluid injection system for injecting fluid into the processor;

an air intake for injecting air into the processor and wherein the air intake includes an input surface area;

a vortex chamber that atomizes fluid from the fluid injection system with air from the air intake to create an atomized air fluid combination; and an exit nozzle that ejects the atomized air fluid combination, wherein the exit nozzle includes an output surface area, and wherein the output surface area is substantially equal to the input surface area so as to maintain a pressure differential to generate and maintain an internal vacuum;

wherein the exit nozzle includes an outward tapering conical center hole and a plurality of outward tapering cylindrical holes, and wherein the outward tapering cylindrical holes intersect the conical center hole in a manner to negate all helixing in the atomized air fluid combination, and wherein the outward tapering cylindrical holes have a total internal surface area equal to a total internal surface area of the conical center hole.

* * * * *